United States Patent [19]

Svoboda

[11] 4,361,345

[45] Nov. 30, 1982

[54] SAFETY-STRAPLIKE CONNECTING MEMBER

[75] Inventor: Josef Svoboda, Schwechat, Austria

[73] Assignee: TMC Corporation, Baar, Switzerland

[21] Appl. No.: 243,114

[22] Filed: Mar. 12, 1981

Related U.S. Application Data

[62] Division of Ser. No. 31,493, Apr. 19, 1979, Pat. No. 4,312,519.

[30] Foreign Application Priority Data

Apr. 21, 1978 [AT] Austria ..... 2897/78

[51] Int. Cl.[3] ..... A63C 9/00

[52] U.S. Cl. ..... 280/637; 280/622

[58] Field of Search ..... 280/637, 622, 614, 601, 280/605, 604, 809, 611, 11.36

[56] References Cited

U.S. PATENT DOCUMENTS

| | | | |
|---|---|---|---|
| 3,448,989 | 6/1969 | Marker | 280/637 |
| 3,490,782 | 1/1970 | Hatlapa | 280/637 |
| 3,549,163 | 12/1970 | Wiedermann | 280/637 |
| 3,796,438 | 3/1974 | Zimmet | 280/637 |
| 3,884,488 | 5/1975 | Riedel | 280/637 |
| 3,913,930 | 10/1975 | Okonski | 280/637 |
| 3,918,730 | 11/1975 | Schultes | 280/605 |
| 4,039,204 | 8/1977 | Frey | 280/605 |
| 4,171,827 | 10/1979 | Gley | 280/605 |

*Primary Examiner*—Joseph F. Peters, Jr.
*Assistant Examiner*—Milton I. Smith
*Attorney, Agent, or Firm*—Blanchard, Flynn, Thiel, Boutell & Tanis

[57] ABSTRACT

A structure for securing one end of a safety strap to a ski or to a component fixedly mounted on the ski. The other end of the safety strap is presumed to be secured to the skier by any conventional means. The structure by which the safety strap is secured to the ski structure enables the strap to hold the ski to the skier should the ski become disconnected from the skier while travelling on a chairlift or at slow speeds. However, this same structure will facilitate a release of the strap from engagement with the ski structure should the ski be pulled away from the skier with a sufficient magnitude of force, such as will occur during falls at high speeds. The thereafter released ski will be stopped by, for example, a ski brake mechanism mounted on the ski.

3 Claims, 17 Drawing Figures

SAFETY-STRAPLIKE CONNECTING MEMBER

CROSS-REFERENCE TO RELATED APPLICATION

This is a divisional application of Ser. No. 031 493, filed Apr. 19, 1979 and now U.S. Pat. No. 4,312,519, issued Jan. 26, 1982.

FIELD OF THE INVENTION

The invention relates to a safety-straplike connecting member for safety ski bindings which are equipped with a ski brake, preferably as a safety mechanism during travel on chairlifts, which is secured or hinged through one of its ends by means of eyelets, hooks, or the like and a lock either on the ski boot or a ski-fixed binding part or the like or to the ski and can be releasably fixed, in particular can be locked by means of a releasable locking mechanism, through its other end either to the ski or to a ski-fixed binding part or the like or to the ski boot.

BACKGROUND OF THE INVENTION

A safety-straplike connecting member of the above-mentioned type is for example described in Austrian Pat. No. 289 613. In this known construction the connection between ski boot and safety ski binding or ski consists of a band-shaped multiply bent member, which is nonreleasably secured, however, is swingable through a limited range relative to the safety ski binding. The band-shaped member is arbitrarily releasably secured to the ski boot. A disadvantage of the known device consists in the use of one structural part, which is either only arbitrarily releasably connected to the ski boot or performs uncontrolled swivelling movements in the loose condition (not locked on the ski boot) and thus creates a dangerous condition for the skier. Furthermore the band-shaped member is a relatively large bulky structural part.

It is also known according to Austrian Pat. No. 270 471 to use a catch mechanism for skis, wherein same is in the region of the safety ski binding, and creates a connection, through an automatic coupling during stepping into the safety binding, with a fastening part which is provided on the ski boot. However, it is not possible with this construction to release the safety mechanism from the ski boot, as long as same is locked in the safety ski binding.

According to French Pat. No. 2 147 916 it is furthermore known, to design a catch mechanism which consists of a plastic material such that same is arbitrarily releasably fixed to the ski boot with one of its ends and is with its other end either secured ski-fixed or fixed through a notch on a ski brake, which notch releases during an overload and releases the ski brake. The disadvantage of this device is in the mandatory use of mountings on the ski boot, furthermore in the catch mechanism being able to be mounted only in the front area of the ski boot, and—if existing—the ski brake also having to be arranged in front of the front jaw. All of these solutions are, based on experience, nonfavorable, since the skier during a fall experiences a sudden jerk or pull at the most sensitive area of the foot. Therefore, such solutions were unable to be successful on the market, in spite of repeated attempts.

The goal of the invention is to avoid the mentioned and further disadvantages of known constructions and to provide a safety-straplike connecting member, which either releases automatically during an overload, or can also be moved into a loose position, when the ski boot is in an engaged condition in the safety ski binding.

The set purpose is inventively attained by the connecting member being constructed as an elastic band or as a fixed, multipart member which is provided with at least one hinge and which can be folded and by the locking mechanism having at least one resilient element which can engage directly or through a connecting piece indirectly arbitrarily with a counterpiece which is constructed as a notch. The locking mechanism will, at least upon the occurrence of an overload of a predetermined magnitude, be released automatically, preferably also by hand and without encountering the entire closing force of the locking mechanism.

A further advantage of an inventive construction includes the locking mechanism being arbitrarily released also in the case of an engaged safety ski binding. In a different exemplary embodiment, the safety ski binding becomes engaged when the safety strap is locked on the ski.

Further details, advantages and characteristics of the invention will be described with reference to the drawings, which illustrate five exemplary embodiments.

Since the structure of the safety ski binding which is illustrated in the following exemplary embodiments is known by itself and these are only used to illustrate the arrangement of the inventive chairlift safety mechanism, they will be described hereinafter only as one unit.

BRIEF DESCRIPTION OF THE DRAWINGS

In the drawings:

FIG. 6 is also a perspective view of the resilient element, FIG. 7 is a side view of the assembly of a safety ski binding with the inventive locking mechanism thereon, and FIG. 8 is a top view of FIG. 7;

FIGS. 11 to 15 illustrate a fourth exemplary embodiment of the inventive locking mechanism, in which an effective closing (a locking) of the safety ski binding is only possible when the safety strap is connected, and in which parts of the safety ski binding are illustrated in opened condition, wherein FIG. 11 is a side view of the safety ski binding in the opened position without a connected safety strap, FIG. 12 is a partially sectioned perspective view of the structural part which receives the resilient element, FIG. 13 is a perspective view of the locking part of the element, FIG. 14 is a partially sectioned side view of the safety ski binding with the connected counterpart of the locking mechanism in the position prior to closing (locking) of the safety ski binding, and FIG. 15 illustrates the safety ski binding in the closed condition according to FIG. 14; and FIGS. 16 and 17 illustrate a further locking mechanism, wherein FIG. 16 is a side view of the not connected position and FIG. 17 is a side view of the connected position.

DETAILED DESCRIPTION

Figure 1:
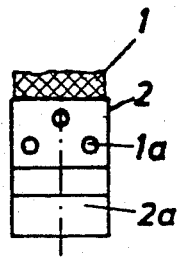
FIG. 1 is a front view of a locking part of a locking mechanism which is associated with a safety strap.
Figure 2:
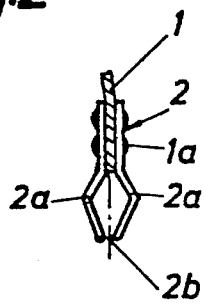
FIG. 2 is a side-elevational view of FIG. 1.
Figure 3:
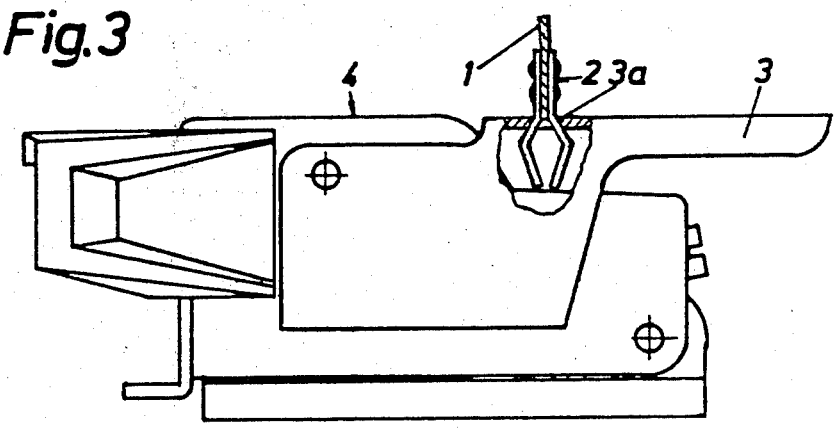
FIGS. 3 and 4 are a side view and a top view, respectively, of the locking part partially cross sectioned in use with a counterpart on a safety ski binding.
Figure 4:
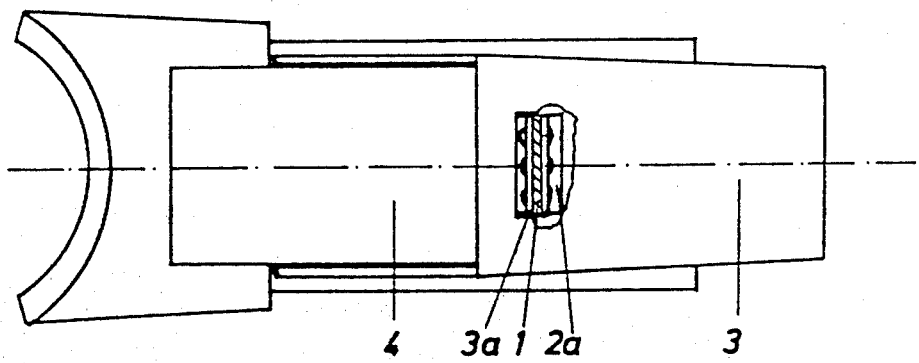
Figure 5:
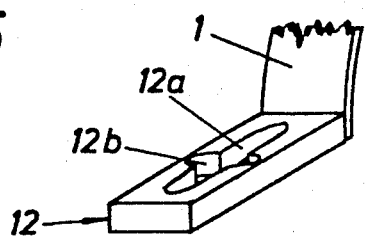
FIGS. 5 to 8 illustrate a different exemplary embodiment of a locking mechanism, wherein FIG. 5 in a perspective view of the counterpiece.

The resilient element of an inventive locking mechanism, which element is constructed as a holding part 2, is secured to one end of a safety strap 1, which end is arranged on a safety ski binding 4 (FIGS. 3 and 4). The holding part 2 consists of two small spring-steel plates riveted together by means of three rivets 1*a* (FIG. 1) arranged in the corners of a triangle and with the safety strap 1 sandwiched therebetween. The rivets 1*a* further extend through the material of the strap 1. The part of the holding part 2, which projects beyond the safety strap 1, is bent such that it forms, as illustrated, in the side-elevational view of FIG. 2, an angled profile 2*a*. Furthermore the two angled profiles, which together form the holding part 2, are symmetrical. The end of the angled profile 2*a* adjacent the safety strap 1, is inclined to the plane 2*c* of the strap at a steeper angle than the profile part remote therefrom. The pair of the profiled parts 2*a* forming the holding part 2 at an end thereof remote from the safety strap 1 forms a squarelike profile having an open corner defining a space 2*b* between the two free ends of the angled profiles 2*a*.

An elongated slot 3*a*, the length of which extends perpendicular with respect to the longitudinal axis of the ski, is provided in a release lever 3 of a conventional safety ski binding 4, as this is illustrated in FIGS. 3 and 4, and on a side thereof which is remote from a ski (not shown). The width of the slot 3*a* is slightly larger than the width of the holding part 2 as is illustrated in FIG. 4. The dimension of the slot 3*a* in direction of the longitudinal axis of the ski is slightly less than the greatest dimension of the square forming profiles 2*a*. The safety strap 1 is secured by means of its other end in a conventional manner through a ski boot (not shown) to the foot of the skier.

If a skier has entered into the safety ski binding, he must, in order to obtain a "chairlift lock device", that is, a securement of the safety strap to the skier to withstand the force imposed by a ski becoming free of the skier riding on the chairlift, introduce the holding part 2, as can be seen from the drawing according to FIGS. 3 and 4, into the slot 3*a* provided in the release lever 3. Due to the flatter rise of the square forming profiles 2*a* at the end of the holding part remote from the safety strap 1 and due to the fact that between the ends of holding part 2 there exists a space 2*b*, and due to the use of spring steel for the manufacture of the holding part 2, it is relatively simple to introduce the holding part 2 into the slot 3*a* without applying a great amount of force. The holding part 2 is thereby positioned substantially perpendicular to the release lever 3. The holding part 2 is prevented from falling out of the slot 3*a* by the square forming profiles 2*a*. Also a substantially greater force must be applied to effect a pulling of the safety strap 1 or the holding part 2 out of the slot 3*a* of the release lever 3 than is needed for inserting same into the opening.

If now due to unfavorable circumstances the safety ski binding 4 opens unintentionally, for example during travel on a chairlift, the ski can only fall downwardly until the length of the safety strap 1 limits this movement. The holding part 2 is made of such a strong spring steel sheet metal and the square forming profiles 2*a* are constructed such that in the one case, as just described, the holding part 2 is not pulled out of the slot 3*a*. If the skier falls during low speed, approximately at a walking speed or only at a slightly faster speed of travel, the holding part 2 will not be pulled out of the slot 3*a*. At any rate there does not as yet exist any danger to the skier from the ski which is secured to him/her by means of the safety strap, and it has the advantage that the skier must not go back to get the ski which has been stopped by the ski brake. However, if the skier falls at a faster speed, where the ski would be likely to create a dangerous condition for the skier, the safety strap 1 or the holding part 2 will be pulled out of the slot 3*a*, and the ski will be stopped in a conventional manner by the ski brake.

The exemplary embodiments according to FIGS. 5 to 8 also disclose a safety strap 1, which is intended as a "chairlift lock device" and which will be pulled free from a safety ski binding 4 upon an overload, such as will occur during falls at fast speeds. A holding part 12 is also riveted by means of rivets 1*a* to the safety strap 1. The holding part 12 is a rectangular structural part having a substantially constant thickness. The holding part 12 is elongated, and has extending in the longitudinal direction, as can be seen from the drawing according to FIG. 5, a slot 12*a* therein, the length of which will be described in more detail below, and the ends of which each have a radius. Approximately in the center of the slot 12*a* there is provided a laterally extending slot 12*b* which crosses the slot 12*a* and which has a size which will be described more in detail below.

Figure 6:
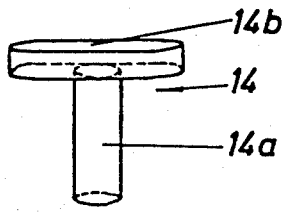

A T-shaped or hammerlike part 14 which is illustrated in FIG. 6 consists of an elastic material, preferably of rubber, or the like and has a stem 14*a* with an oval cross section, and on which is provided an elongated head part 14*b*, the shape of which corresponds approximately with the shape of the slot 12*a*, excluding the notches defined by the laterally extending slot 12*b*. The width of the notches 12*b* in the holding part 12 is slightly smaller than the larger diameter of the oval stem 14*a*.

The T-shaped part 14 is secured to the release lever 13 of the safety ski binding 4 so that the longitudinal axis of the stem 14*a* stands perpendicularly on the release lever 13 such that the head part 14*b* lies parallel with respect to the longitudinal axis of the ski.

Figure 7:
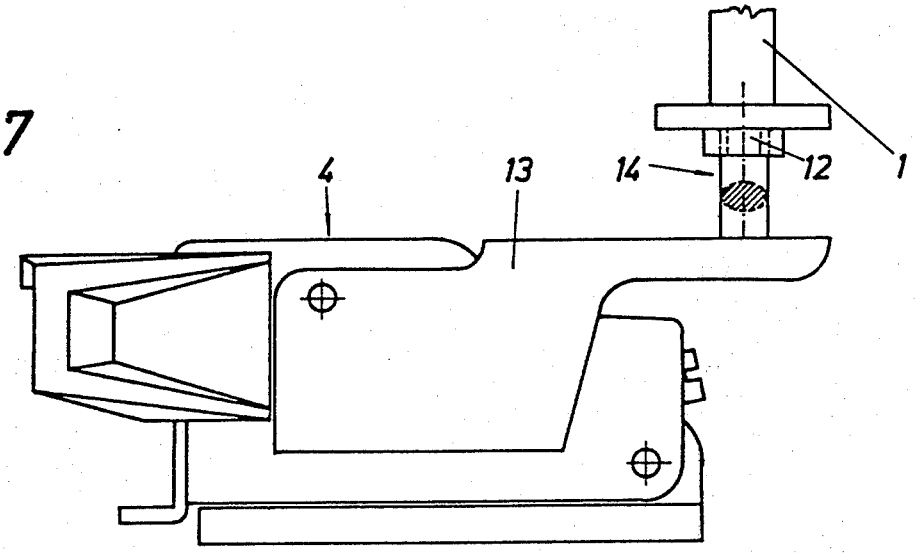
Figure 8:
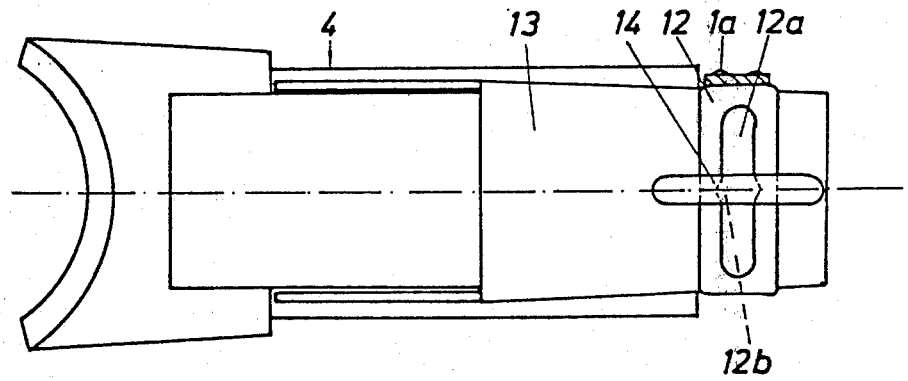

After the skier has entered into the binding, he moves the holding part 12 corresponding with its form onto the T-shaped part 14, until it has reached the stem 14*a*, and swings or turns then the holding part 12 at 90° about its longitudinal axis into the position illustrated in FIGS. 7 and 8. Due to the fact that the largest diameter of the stem 14*a* of the T-shaped part 14 is larger than the recess, (width of the slot 12*a* and the two notches 12*b*), transversely with respect to the longitudinal direction of the holding part 12, the holding part 12 is jammed onto the T-shaped part 14.

If now the ski falls downwardly away from the skier during travel on a chairlift, the ski will be held to the skier by the safety strap 1. As in the exemplary embodiment according to FIGS. 1 to 4, the safety strap 1 does not disengage from the T-shaped part 14 even during falls at slow speed. Only during falls at faster speeds will the holding part 12 be pulled off from the T-shaped part 14. The two ends of the head part 14*b* are thereby pulled by the holding part 12 in a direction away from the safety ski binding 4 approximately vertically upwardly, and form approximately an extension of the stem 14*a*. The notches 12*b* which are provided in the holding part 12 make it possible for the holding part to slide over the collapsed head part 14*b*. Furthermore, the T-shaped part 14 can be manually gripped when used as a hangle for effecting an easier manual opening of the release lever 13.

Figure 9:
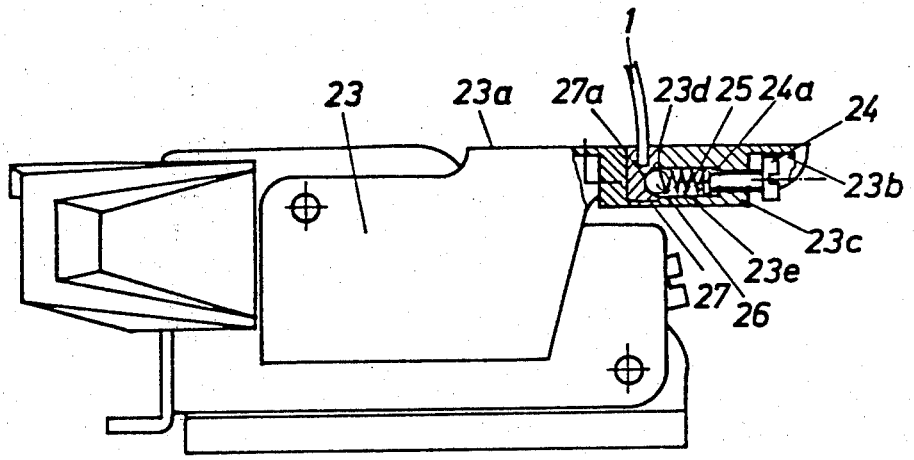
FIGS. 9 and 10 are a side and top view, respectively, partially in cross section of a further exemplary embodiment.
Figure 10:
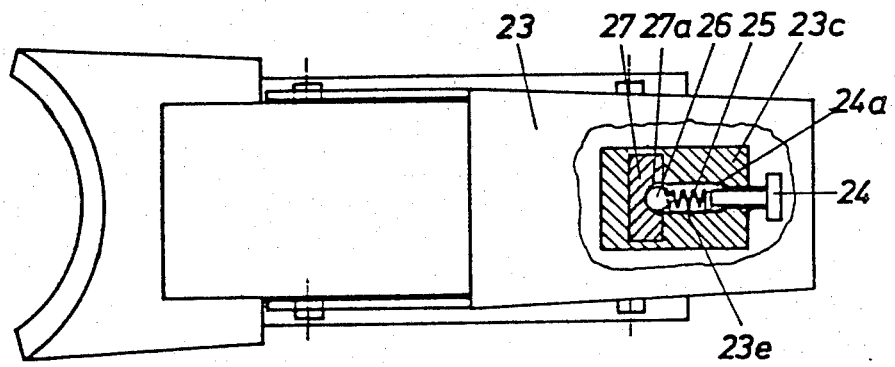

In the exemplary embodiment according to FIGS. 9 and 10, a release lever 23 of a safety ski binding 4 has on its underside 23*b* a rectangular-shaped, in longitudinal cross section, enlargement 23*c* of constant thickness. The release lever 23 has a rectangular-shaped recess 23*d* on its upperside 23*a*, which recess extends into the enlargement 23*c*, however, does not extend completely therethrough. The enlargement 23*c* is provided approximately on the longitudinal axis of the ski and is designed substantially symmetrical thereto. The enlargement 23*c* part of the release lever 23 has an opening 23*e* in the region of the longitudinal axis of the ski which extends perpendicularly with respect to the width of the slot 23*d* and opens outwardly toward the tail of the ski.

The opening terminates at one end in the slot 23*d*. The other end of the opening 23*e*, which end opens outwardly toward the tail of the ski, is provided with a thread extending approximately over one third of the length of the opening 23*e*. After this first third, the opening 23*e* is stepped into a larger diameter. Shortly before terminating in the rectangular slot 23*d*, the opening 23*e* is tapered slightly. An adjusting screw 24 having a slotted head threadedly engages the threaded part of the opening 23*e*. The adjusting screw 24 has at its end remote from the head a platelike part 24*a*. A coil spring 25 is supported at one end thereof on the platelike part 24*a*. The coil spring 25 engages at its other end a locking ball 26, the diameter of which is slightly larger than the diameter of the opening 23*e* in the region whereat it terminates in the rectangular slot 23*d*. As a result, it is not possible for the ball 26 to be pressed completely into the slot 23*d*. With the aid of the adjusting screw 24, it is possible to change the initial tension of the coil spring 25 and, as a result, the release value of a locking part 27 or of the safety strap 1 from the release lever 23 can be changed. The selection of the spring 25 determines the limits between which the release force can be adjusted.

The end of the safety strap 1 which is associated with the release lever 23, is gripped by the locking part 27. The locking part 27 is a rectangular member having a substantially constant thickness. Only on one side, as can be seen from the drawings according to FIGS. 9 and 10, does the locking part 27 have an approximately semispherical-shaped locking cup 27*a*. If the skier has entered, as in the two preceding exemplary embodiments according to FIGS. 1 to 8, into the safety ski binding 4, he then places the end of the safety strap 1 having the locking part 27 thereon into the rectangular slot 23*d* of the release lever 23 so that the locking ball 26 is received in the locking cup 27*a* in the locking part 27. Just as in the preceding two exemplary embodiments, here too the ski (not shown) is prevented from falling downwardly to the ground from for example a chairlift, because the locking part 27*a* will not become disengaged in such a case from the locking cup 26. Also locking ball 26 and locking part 27 remain in engagement during falls which occur at relatively slow speeds. In the case of falls at a high speed, the safety strap 1 is pulled out of its locking relation with the release lever 23 and the ski (not shown) is stopped by the ski brake on the ski.

Figure 12:
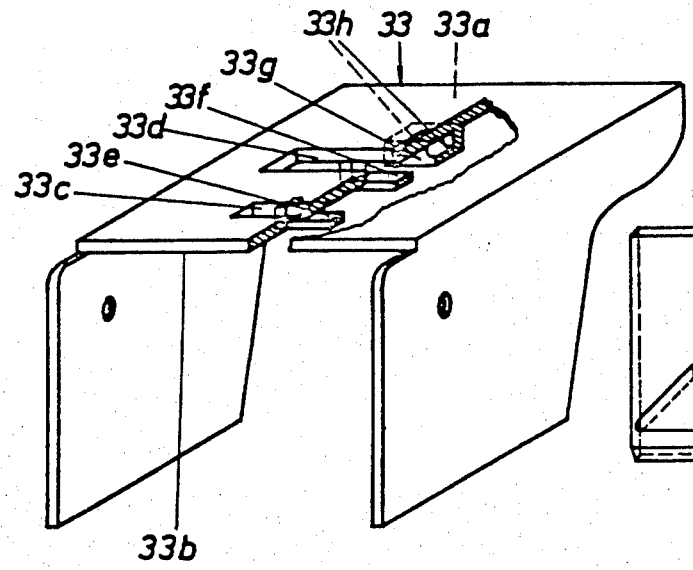
Figure 13:
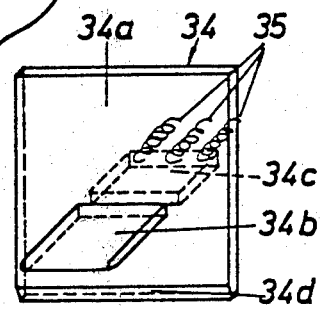
Figure 14:
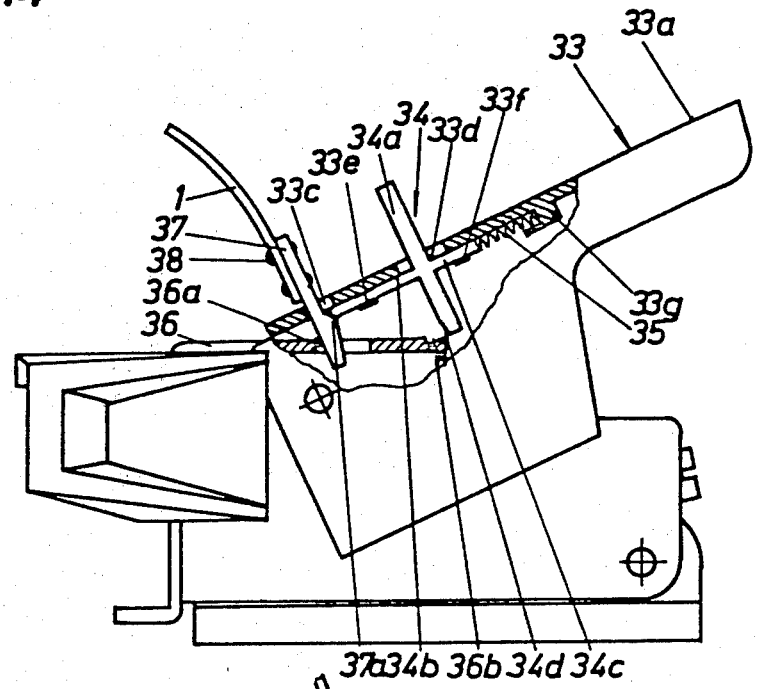

A closing of the heel hold down means of a safety ski binding, which closing is associated with a locking thereof, is only possible in the exemplary embodiment according to FIGS. 11 to 15, if the safety strap 1 is in the locked position, as shown in the position according to FIG. 14.

The release lever 33 has, as can best be seen from the inclined cross-sectional illustration according to FIG. 12, a small slot 33*c* and a large slot 33*c* and a large slot 33*d*. The large slot 33*d* is provided in direction toward the tail of the ski behind the small slot 33*c*. Both the large slot 33*d* and also the small slot 33*c* are designed substantially rectangular in shape, are provided in the region of the longitudinal axis of the ski, are oriented perpendicularly with respect to same and are positioned substantially symmetrical about the central longitudinal axis of the release lever. Furthermore two rectangular plates 33*e*, 33*f* are mounted on the underside 33*b* of the release lever 33. The plate 33*e* is provided between the two slots 33*c*, 33*d* and the other plate 33*f* is provided in direction toward the tail of the ski behind the large slot 33*d*. The width of the plates 33*e*, 33*f* will be described more in detail hereinbelow. A substantially rectangular support block 33*g* is provided on the underside 33*b* of the release lever 33 behind the plate 33*f* in direction toward the tail of the ski. The support block 33*g* is approximately as wide as the two rectangular plates 33*e*, 33*f*. The support block 33*g* has on its side which is remote from the tail of the ski and which lies perpendicular with respect to the longitudinal axis of the ski three blind holes 33*h* of a diameter which will be described more in detail below.

A locking part 34 having an irregular shape has a substantially rectangularly-shaped operating plate 34*a* of a substantially constant thickness, has approximately in the central region on each side thereof one locking plate 34*b*, 34*c*, which are supported on the rectangular plates 33*e*, 33*f* on the release lever 33 such that the operating plate 34*a* extends through the large slot 33*d* in the release lever 33 perpendicularly with respect to the planar surface of the release lever 33 and permits the locking part 34 to undergo a limited amount of movement in direction of the longitudinal axis of the ski. The path which the locking part 34 can cover is determined by the dimension of the large slot 33*d* in direction of the longitudinal axis of the ski.

The locking part 34 is biassed by three coil springs 35 which engage at one end thereof an edge of the locking plate 34*c* which faces the tail of the ski. The other ends of the coil springs 35 are received in the three blind holes 33*h* provided in the support block 33*g* of the release lever 33. The diameters of the blind holes 33*h* are slightly larger than the diameters of the coil springs 35.

The free end of the locking plate 34*b* which is remote from the end of the ski has a radius thereat. Furthermore said locking plate 34*b* is approximately twice as long as the locking plate 34*c* which faces the tail of the ski. The end of the locking plate 34*b* having the radius thereat, is aligned with the approximate longitudinal center of the small slot 33*c* when the locking part is in the position which is most remote from the tail of the ski. Approximately in the area below the small slot 33*c*, there is provided a binding-fixed structural part 36 having an opening 36*a* therein, which opening 36*a* permits an unrestricted introduction of a locking part 37 into the small slot 33*c*. Thereafter, the release lever 33 is swung to the closed condition.

Figure 15:
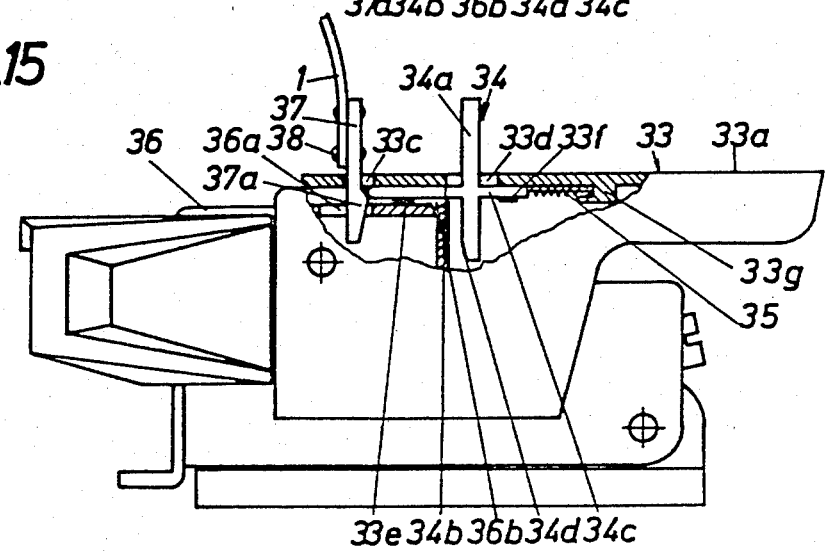

The locking part 37 is, as can be recognized from FIGS. 14 and 15, a rectangular member having a substantially constant thickness and has on its side which faces the tail of the ski an enlargement 37*a*. The enlargement 37*a* starts at the end of the locking part 37 remote from the safety strap 1, and rises slowly and continuously before it drops off steeply to the part having a substantially constant thickness. The enlargement 37*a* extends approximately half of the length of the locking part 37 which is riveted to the safety strap 1 by means of rivets 38. The safety strap 1 is riveted to the side of the locking part 37 remote from the tail of the ski.

As can be recognized from the perspective view according to FIG. 13, the operating plate 34*a* of the locking part 34 has at one edge a sloped surface 34*d*. The purpose of the sloped surface 34*d* will be described more in detail hereinbelow.

Figure 11:
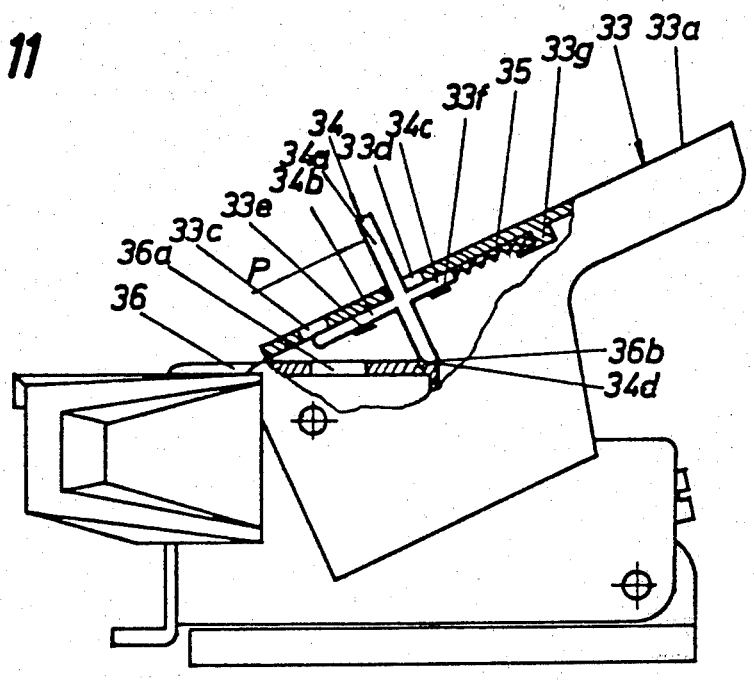

In the lifted-up condition of the release lever 33, as illustrated in FIG. 11, the end of the operating plate 34*a* having the sloped surface 34*d* thereon, rests in a correspondingly shaped groove 36*b* provided at an edge of the binding-fixed structural part 36. The sloped surface 34*d* assures the secure resting of the operating plate 34*a* in the groove 36*b*.

As can be seen according to FIG. 11, it is impossible to close the release lever 33, as long as the locking part 37 is not in the small slot 33*c*.

Due to the slow and continuous rise of the enlargement 37*a*, it is now easy to introduce the locking part 34 into the small slot 33*c* to effect a moving back of the locking part 34. During this movement the operating plate 34*a* becomes disengaged from the groove 36*b* associated therewith, and it is possible to swing the release lever 33 in a clockwise direction and to thus lock the safety ski binding. In order to prevent a possible catching of the operating plate 34*a* on the rear edge of the binding-fixed structural part 36, the operating plate 34*a* has the aforementioned sloped surface 34*d*.

With respect to ski loss during chairlift travel or falls, the locking securement of the locking part 37 to the release lever 33 behaves as in the described exemplary embodiments according to FIGS. 1 to 10. For a voluntary opening, it is possible to manually move the locking part 34 in direction of the arrow P against the force of the springs 35, so that little or no force is needed.

Figure 16:
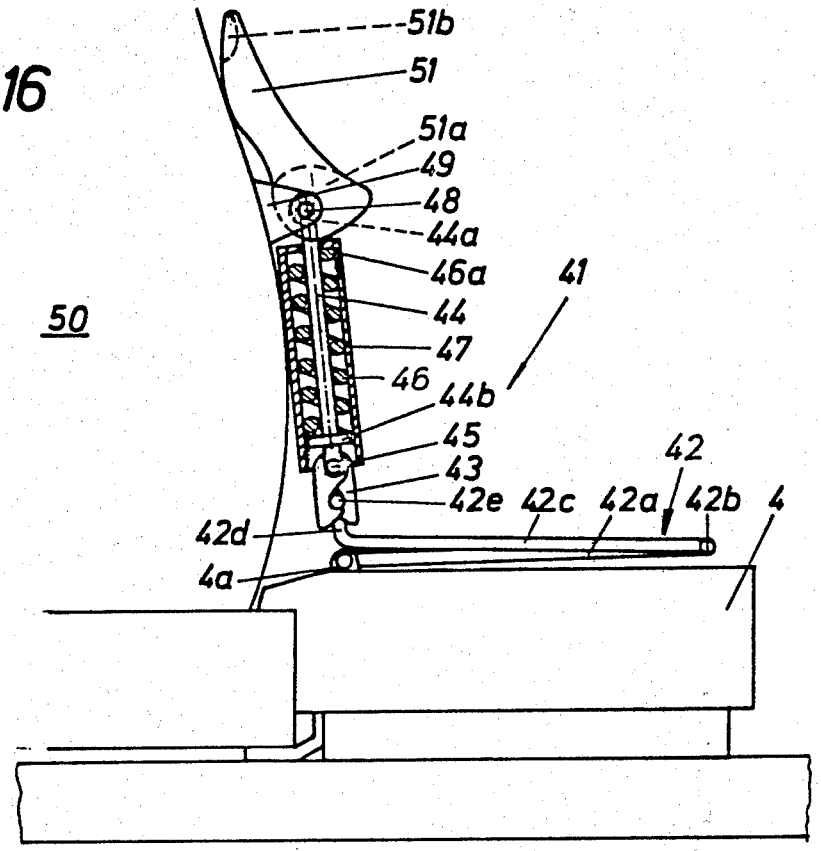
Figure 17:
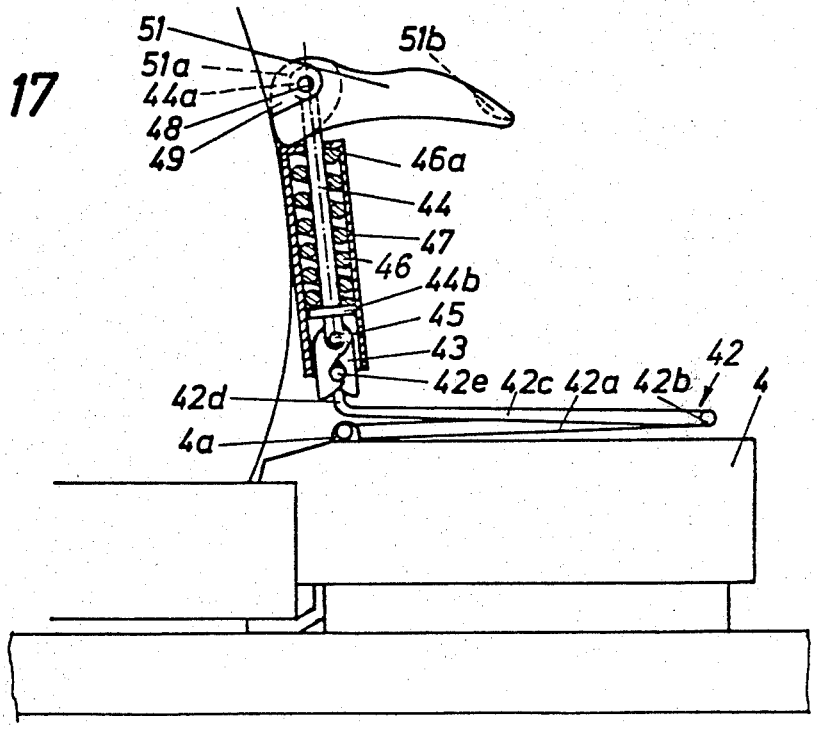

In the exemplary embodiment which is illustrated in FIGS. 16 and 17, a safety strap is not used but instead a catching mechanism 41 is used. A safety ski binding 4 of common structure is secured to a ski (not identified). A plate 4*a* is secured on the safety ski binding 4, which plate is provided with an opening 4*b*, the axis of which extends perpendicularly with respect to the longitudinal axis of the ski. A two-part holding bar 42 is pivotally supported through a limited range in the opening 4*b*. The first part 42*a* is designed substantially straight and is hingedly connected to the second part 42*c* by means of a hinge 42*b*. In the region of the plate 4*a* the second part 42*c* is bent at almost 90° in a direction away from the safety ski binding 4 to form a section 42*d*. The second part 42*c* also has at the just now described end a bent section 42*e* extending at a right angle to the section 42*d* and generally parallel to the axis of the opening 4*b*.

Two brackets 43 are provided in the area of the bent section 42*d* or the bend 42*e* arranged thereon. The brackets 43 are both hook-shaped and are supported on one end of a holding rod 44 by means of a laterally extending pin 45 such that the hook-shaped parts face one another. The other end of the holding rod 44 has an eyelet 44*a* formed thereon. The holding rod 44 has in the region of the end which faces the brackets 43 a shoulder 44*b*. A hollow cylinder 46, the diameter of which is sufficiently large that it can grip over the brackets 43, when these are in the position according to FIG. 17, grips over the just now described structural parts. The end of the cylinder 46 remote from the brackets 43 is closed off and has in the center an opening 46*a* extending therethrough. The holding rod 44 extends through the opening 46*a*. The cylinder 46 is designed sufficiently long that it extends in the opened position of the safety mechanism 41 in direction of the brackets 43 approximately to the pin 45. A coil spring 47, which is supported with one end on the shoulder 44*b* of the holding rod 44, biasses the cylinder 46 in direction away from the safety ski binding 4.

The holding rod 44 is supported by means of a hinge pin 48, which normally extends through the eyelet 44*a* and through openings in a bearing part 49 fixedly connected to the ski boot 50. Furthermore, a lever 51 is pivotally supported through a limited range on the hinge pin 48. The lever 51 has in the area of the bearing part 49 a fork-shaped part 51*a*, which permits it to carry out an unrestricted swinging movement in spite of the existence of the holding rod 44 in this region.

Due to the special construction of the lever 51 in the region of the fork-shaped part 51*a*, it is possible for the cylinder 46 to be locked or fixedly held in two positions. Furthermore, the lever 51 has at its end which is remote from the fork-shaped part 51*a* a depression 51*b*, which facilitates an operation of the same with a ski pole.

If the skier now enters the safety ski binding 4, the two brackets 43 slide over the bent sections 42*e*, which are on the second part 42*c* of the catch mechanism 41 in the region of the bent section 42*d*. Due to the special form of the brackets 43, these are spaced apart and will, as soon as the safety ski binding 4 is locked, lie in the position as is illustrated in FIG. 16. The lever 51 is then in the position according to FIG. 16. The highest point of the fork-shaped part 51*a*, which loads the cylinder 46, is thereby farther away from the ski boot 50 than the holding rod 44. The lever 51 receives thereby a torque in counterclockwise direction. Since the lever 51 rests on the ski boot 50, it is thus locked in this position and is also secured against vibration. Since no connection at all exists between the brackets 43 and the two-part holding bar 42, the catch mechanism 41 behaves during a fall just as if it was not at all in existence.

If the skier moves the lever 51 into the position illustrated in FIG. 17, as this will be the case prior to travelling on the chairlift, the cylinder 46 will be moved due to the camlike form of the fork-shaped part 51*a* against the force of the coil spring 47 over the brackets 43. The brackets 43 are closed and grip around the bent section 42*e*. A loss of the ski (not identified in detail) is now no longer possible, because the connection between the brackets 43 cannot be released in this possible. The point on the lever 51, which loads the cylinder 46 and engages the end of the cylinder in the locked position is torqued in the clockwise direction by the coil spring in the cylinder 46 to cause the lever 51 to be held in the locking position. If the lever 51 is again moved into the position according to FIG. 16, then the two brackets 43 again rest releasably on the bent section 42*e* of the second holding part 43*c*.

The invention is not limited to the illustrated exemplary embodiments. Further modifications are conceivable, without departing from the scope of the invention. For example, the connection between ski boot and ski can be designed as a rope, which rope is wound up onto a spring-loaded drum. It is also possible that the safety strap is locked on a different ski-fixed structural part than the release lever. Also the adjustment of the cylinder can be designed differently. For example, two locking points on the holding rod or on the locking part would be sufficient for this purpose. In place of the used coil spring, it would also be possible to use cup springs or leaf springs.

Although particular preferred embodiments of the invention have been disclosed in detail in illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A retaining device adapted for use with a ski having a ski binding mounted thereon releasably securing a ski shoe to the ski, said device comprising:

a safety strap, one end of said safety strap being releasably securable to the leg of a skier;

a first locking part securely attached to the end of said safety strap remote from said one end and having an enlargement thereon;

a release lever provided on said ski binding and having two spaced slots therethrough, one said slot being adapted to receive said first locking part therein;

a second locking part supported in the other said slot for reciprocal movement longitudinally thereof between first and second positions, having an operating plate extending substantially normal to the direction of said reciprocal movement, and having at least one locking plate which is located adjacent said one slot when said second locking part is in said first position and engages said enlargement on said first locking part when said first locking part is received in said one slot to resist withdrawal of said first locking part from said one slot, said second locking part being in a third position intermediate said first and second positions when said locking plate is engaging said enlargement;

resilient means cooperable with said second locking part for urging said second locking part toward said first position; and means defining a sloped surface on at least one of said enlargement and said locking plate at the point of engagement therebetween;

whereby a force of sufficient magnitude exerted through said safety strap on said first locking part will act through said sloped surface means to displace said second locking part toward said second position against the force of said resilient means, thereby disengaging said enlargement from said locking plate and facilitating withdrawal of said first locking part from said one slot.

2. The retaining device according to claim 1, wherein:

said release lever is pivotally supported on said ski binding for movement between open and closed positions;

said operating plate on said second locking part includes a sloped area at an end thereof adjacent said ski binding; and said ski binding includes a groove engageable with said sloped area on said operating plate when said release lever is in said open position and said second locking part is in said closed position to inhibit pivotal movement of said release lever toward said closed position, said sloped area of said operating plate being disengaged from said groove when said second locking part is displaced from said first position.

3. The retaining device according to claim 1, wherein said first and second positions of said second locking part are each determined by engagement of said operating plate with a respective end of said other slot.

* * * * *